United States Patent [19]

Blackburn et al.

[11] Patent Number: 4,820,356

[45] Date of Patent: Apr. 11, 1989

[54] HEAT TREATMENT FOR IMPROVING FATIGUE PROPERTIES OF SUPERALLOY ARTICLES

[75] Inventors: Martin J. Blackburn, Kensington; Daniel F. Paulonis, Higganum; Robert H. Caless, Bolton; Anne L. D'Orvilliers, Hartford, all of Conn.

[73] Assignee: United Technologies Corporation, Hartford, Conn.

[21] Appl. No.: 137,853

[22] Filed: Dec. 24, 1987

[51] Int. Cl.[4] ..... C22F 1/10

[52] U.S. Cl. ..... 148/12.7 N; 148/162; 148/410

[58] Field of Search ..... 148/162, 12.7 N, 410, 148/409

[56] References Cited

U.S. PATENT DOCUMENTS 4,608,094 8/1986 Miller et al. ..... 148/410

*Primary Examiner*—R. Dean

*Attorney, Agent, or Firm*—Charles E. Sohl

[57] ABSTRACT

Heat treatments are described for improving the fatigue properties of superalloy articles, without adversely affecting other mechanical properties. The entire heat treatment process is performed below the gamma prime solvus temperature so that significant grain growth does not occur. The heat treatment cycle causes the formation of gamma prime particles in a controlled manner and morphology, first at the grain boundaries and then within the grains. The resultant microstructure possesses the benefits of a fine grain structure (improved resistance to fatigue crack initiation) and fine gamma prime particle size (improved resistance to crack growth).

8 Claims, 5 Drawing Sheets

H.T. = Heat Treatment
G.P.S. = Gamma Prime Solvus

HEAT TREATMENT FOR IMPROVING FATIGUE PROPERTIES OF SUPERALLOY ARTICLES

TECHNICAL FIELD

The invention relates to heat treatments for superalloy articles to improve fatigue properties.

BACKGROUND ART

Superalloys are materials, usually nickel based, which have useful properties at temperatures on the order of 1000° F. and above and which are widely used in gas turbine engines. Nickel base superalloys generally consist of a gamma (nickel solid solution) matrix containing a strengthening array of gamma prime phase ($Ni_3Al$ type) particles. The particle size and distribution can be altered by heat treatment and this also alters the mechanical properties of the alloy.

One important gas turbine engine application for superalloys is turbine and compressor disks. Disks are internal engine components which support and locate the blades in the gas path. In engine operation the disk rotates at speeds of up to about 10,000 rpm (and higher in small engines) and experience temperatures ranging from up to about 1500° F. at the rim to about 500° F. at the center, known as the bore. Disks must have high tensile strength and high creep and stress rupture resistance. In addition, the disk experiences cyclic stresses which can lead to failure if the fatigue properties are inadequate.

While the invention development focused on disk applications, the invention is not so limited.

These property requirements, in the context of the high temperature environment, have led to the use of superalloy disks in virtually all modern turbine engines. Despite the generally acceptable properties exhibited by currently used disks, there is still a need for components which have yet better properties. Improved disk properties can translate into longer disk lives, lighter engines, or permit engine operation at higher rotational speeds.

As noted above, the properties of superalloys can be altered by heat treatment. Many prior art heat treatment developments for disk materials have included heating above the gamma prime solvus temperature. When the gamma prime solvus temperature is exceeded all the gamma prime dissolves leaving nothing to retard grain boundary motion. This leads to rapid grain growth and results in a coarse grain structure, which usually reduces tensile strength and fatigue initiation life but often improves (reduces) the crack growth rate. Conversely, conventional fine grain structures display long times to fatigue crack initiation but then exhibit relatively rapid crack growth rates.

The invention is a heat treatment which provides a fine grain structure that is more resistant to crack initiation and has a lower crack growth rate than prior art treated fine grain material.

Typical of the art are U.S. Pat. Nos. 4,608,094 and 4,624,716. Pending, commonly assigned, U.S. Application No. 733,446 filed 5/10/85 describes a heat treatment for reducing the fatigue susceptibility of gas turbine engine disks, this pending application is currently the subject of a U.S. Patent Office Secrecy Order.

DISCLOSURE OF INVENTION

The present invention is a heat treatment process which will often be applied to forgings especially those produced according to U.S. Pat. No. 3,519,503, although it also has application to disks produced by other means such as HIP (hot isostatic pressed) powder and disks conventionally forged from ingot starting material. The invention is applicable to nickel base superalloys containing from about 40 to about 70 volume percent of the gamma prime phase. Table I lists several exemplary superalloys and a general disk alloy composition range which can be processed according to the invention.

The starting articles will have a grain size which has been established by the prior thermal mechanical history of the part. In the case of forgings, the grain size will be relatively fine as a result of recrystallization which generally occurs during forging. A typical grain size for disk forgings is ASTM 8 to 12, (0.022–0.006 mm average grain diameter respectively).

An important characteristic of the invention process is that this starting grain size is held essentially constant throughout the process. Preferably the starting grain size does not change by more than about one ASTM unit during the invention process.

FIG. 1 is a block diagram which illustrates the invention steps. FIG. 2 is a schematic diagram of the invention process. Tables II, III and IV illustrate suggested parameters for several widely used disk materials as employed in small, moderate and large parts and the notation in Tables II, III and IV follows that in FIG. 2.

The first step (I) in the process develops coarse grain boundary gamma prime by a subsolvus solution treatment which puts the majority of the gamma prime into solid solution but retains a sufficient amount (at least about 10 volume %) as precipitates to prevent significant grain growth. This heat treatment will be performed at a first heat treat temperature which is 5°–50° F. below the gamma prime solvus and preferably 15°–40° F. below the gamma prime solvus for at least 0.5 hour and preferably 1–10 hours. After this step the part will have some gamma prime retained out of solution (as precipitates) but most of the gamma prime will be in solution. From this first heat treat temperature the articles are cooled at a controlled rate of from about 20°–200° F. per hour and preferably 50°–150° F. per hour to a temperature which is at least 200° F. below the first heat treatment temperature and preferably at least 300° F. below the first heat treatment temperature. This controlled cooling step causes controlled preferential precipitation and growth of coarse gamma prime particles at the grain boundaries, the particles being approximately 1–5 microns in diameter. After the controlled cooling step, the article can be rapidly cooled to room temperature.

The second step (II) in the invention process develops a distribution of fine gamma prime precipitates within the grains and comprises heating the part to a second heat treatment temperature about 10°–250° F. below the first heat treat temperature for a time of at least 0.5 hours and preferably 1–10 hours. This heat treatment again dissolves or solutionizes a portion of the gamma prime particles but grain growth is again prevented. After this step the article is rapidly cooled to room temperature (actually, only the cooling rate down to about 1200° F. affects the gamma prime size, below about 1200° F. the cooling rate is unimportant). In this context rapid cooling means at least as fast as forced air cooling (typically 600° F. in 15 minutes for a 4 inches thick 300 lb. disk) and possibly faster depending on part size. The cooling rate must be sufficiently fast that, after a subsequent tempering step described below, the intragranular gamma prime size is within a critical size range.

This cooling rate in combination with alloy composition, heat treatment temperature and part size and geometry determines the gamma prime particle size within the grains. These relations are complex and require experimental optimization for each combination of alloy and part geometry to achieve a fine internal gamma prime particle size.

Small parts achieve an actual cooling which is close to the gross cooling rate imposed on the part. However, for large parts the thermal mass does not permit achievement of rapid actual cooling rates throughout the part so the actual internal cooling can be relatively slow.

Parts of sizes which are compatible with a rapid actual cooling rate can be heat treated very near, but below the gamma prime solvus, and achieve the desired fine gamma prime particle size. However, parts which experience a slow actual cooling rate must be quenched from lower temperatures, i.e. 100°–300° F. below the gamma prime solvus, to achieve the gamma prime particle size within the desired range.

The inventors have noted a relationship between average precipitate (non grain boundary) gamma prime size and crack growth resistance. This is illustrated in FIG. 3 with maximum crack growth resistance being observed for particle sizes having an average size of less than about 0.15 micron (and preferably less than 0.1 micron). It is not known if there is an actual lower limit but about 0.02 micron is a practical lower limit since the high cooling rates needed to obtain finer sizes are presently impractical.

As previously suggested, it is necessary to vary the second subsolution treatment temperature and cooling rate for a particular part geometry to achieve the desired gamma prime precipitate particle size. Specifically, small parts treated according to this invention (small parts being defined as having a thickness of less than about 1.0 inch and/or weight of less than about 20 pounds) can be forced air cooled (or of course cooled even faster) from a relatively high subsolution treatment temperature, whereas large parts (parts more than about 2 inches thick and/or weighing more than about 100 pounds) must be liquid quenched from a lower subsolution treatment temperature to achieve a comparable fine gamma prime size. For intermediate size parts, (weighing between about 20 and about 100 pounds and/or having a thickness from about 1 to 2 inches, it has been found satisfactory to use a lower subsolution treatment temperature in combination with forced air cooling. This gives a comparable fine gamma prime particle size. Many actual components will have sections or different thicknesses. In such cases, heat treatment parameter compromise is necessary, preferably biased in favor of those sections having the greatest need for fatigue resistance.

The third step in the process is an aging or stabilization step accomplished by heating the article to a third heat treatment temperature of about 1200°–1500° F. for 1–25 hours. This equilibrates the gamma prime particles. Multistep stabilization steps may also be used.

At the conclusion of the invention heat treatment process the article will have a fine grain size which approximates that of the starting grain size with concentration of coarse (1–5 microns average diameter) gamma prime particles at the grain boundaries and a very fine (0.02–0.15 average diameter) uniform gamma prime dispersion within the grains. This structure has been found to provide greatly enhanced crack growth resistance as compared to the prior art microstructures. In addition, since the fine starting grain size is retained, the inherent resistance of a fine grain structure to crack initiation is also retained.

Large size parts will quite likely contain significant internal stresses resulting from the rapid (liquid) cooling step. These stresses can be detrimental in subsequent processing and in eventual service. Residual stresses can be ameliorated by stressing the part sufficiently to cause localized yielding thereby relieving some of the internal stress. For gas turbine engine disks, this stressing can be achieved by spinning the disk and thereby developing centrifugal stresses sufficient to cause slight local yielding. Other stress relief methods may also be employed.

The preceding description of the process outlined in FIG. 1 is the preferred process and is a process which will give the optimum results. FIG. 1 shows a dotted line which bypasses the initial subsolvus treatment and the controlled cooling rate. If this dotted line is followed, the starting material having initial grain size of ASTM 8–12, and the characteristic gamma prime solvus temperature will be processed according to the lower portion of the Figure depending on its size as a small, medium or large part. This processing sequence will produce an improvement in crack growth rate about half that which would be produced by the entire process.

FIG. 4 shows the effect of the invention process on the fatigue life of MERL 76 alloy. The "prior art" curve shows crack growth behavior for conventionally processed MERL 76 material. The "preferred invention" curve shows behavior of MERL 76 material given the complete invention process. The intermediate curve, "modified invention", is for material given a treatment wherein the first heat treatment was eliminated. It can be seen that elimination of the first heat treatment reduces the invention benefit by about half.

The foregoing, and other features and advantage of the present invention will become more apparent from the following description of preferred embodiments and accompanying drawings.

BEST MODE FOR CARRYING OUT THE INVENTION

Figure 1:
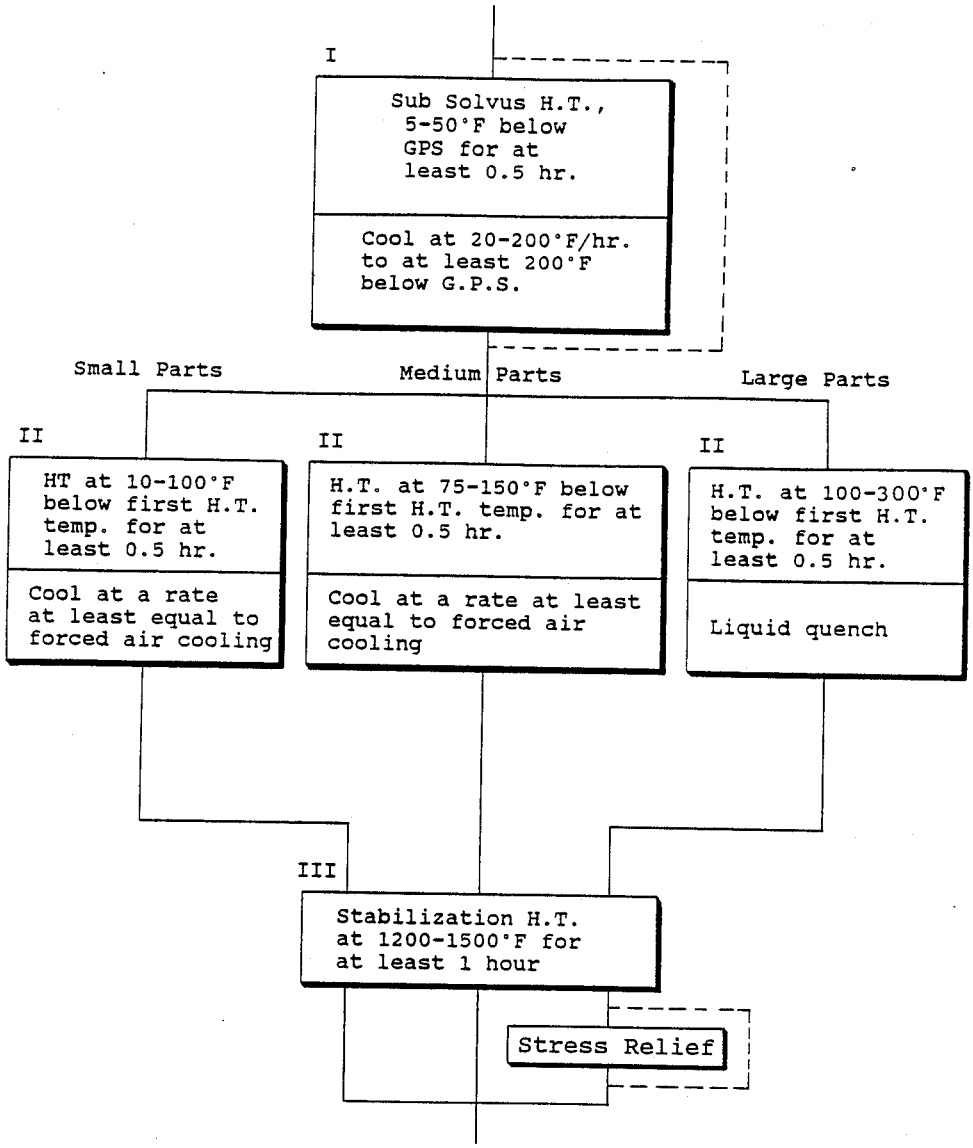
FIG. 1 is a block diagram of the invention process.
Figure 2:
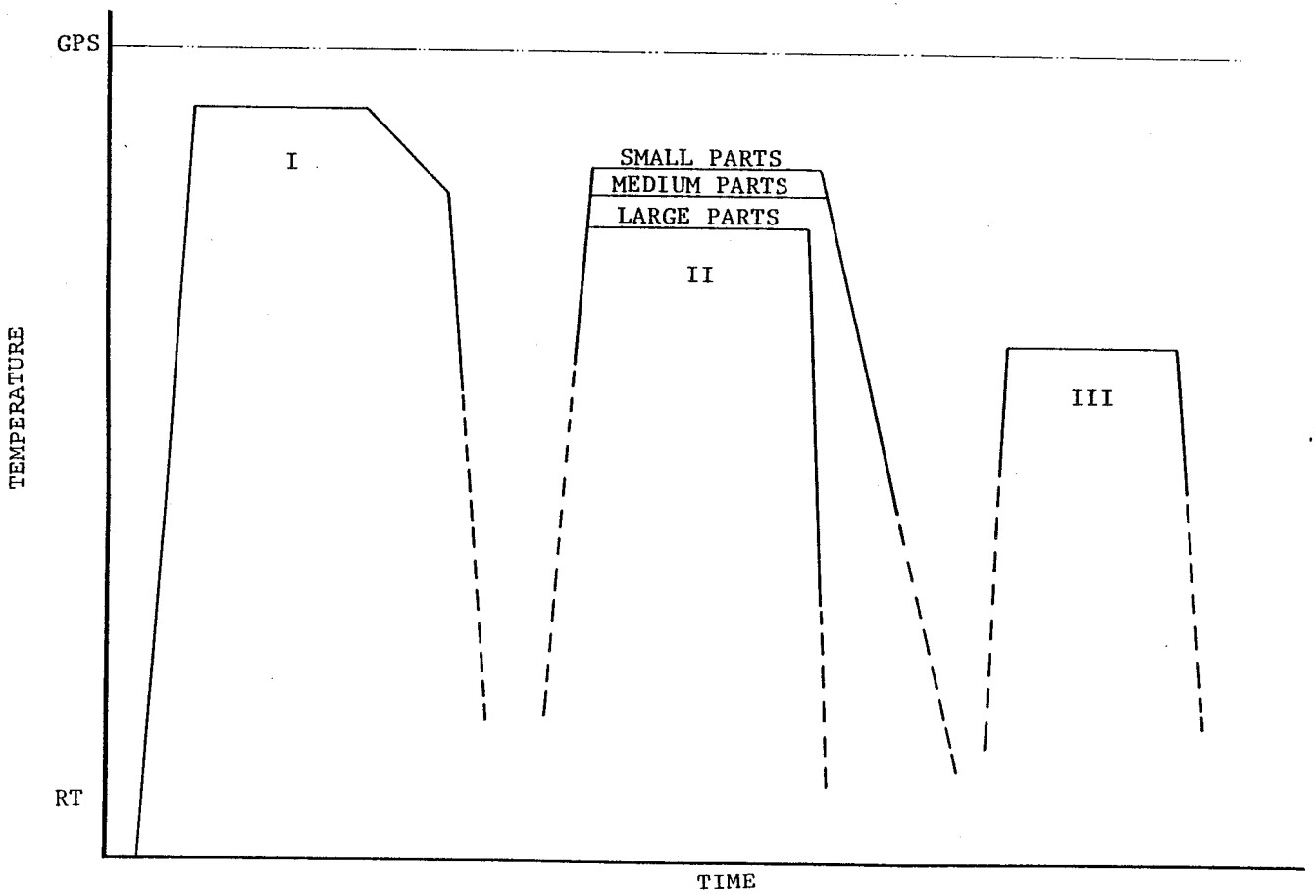
FIG. 2 is a schematic diagram of the invention process.
Figure 3:
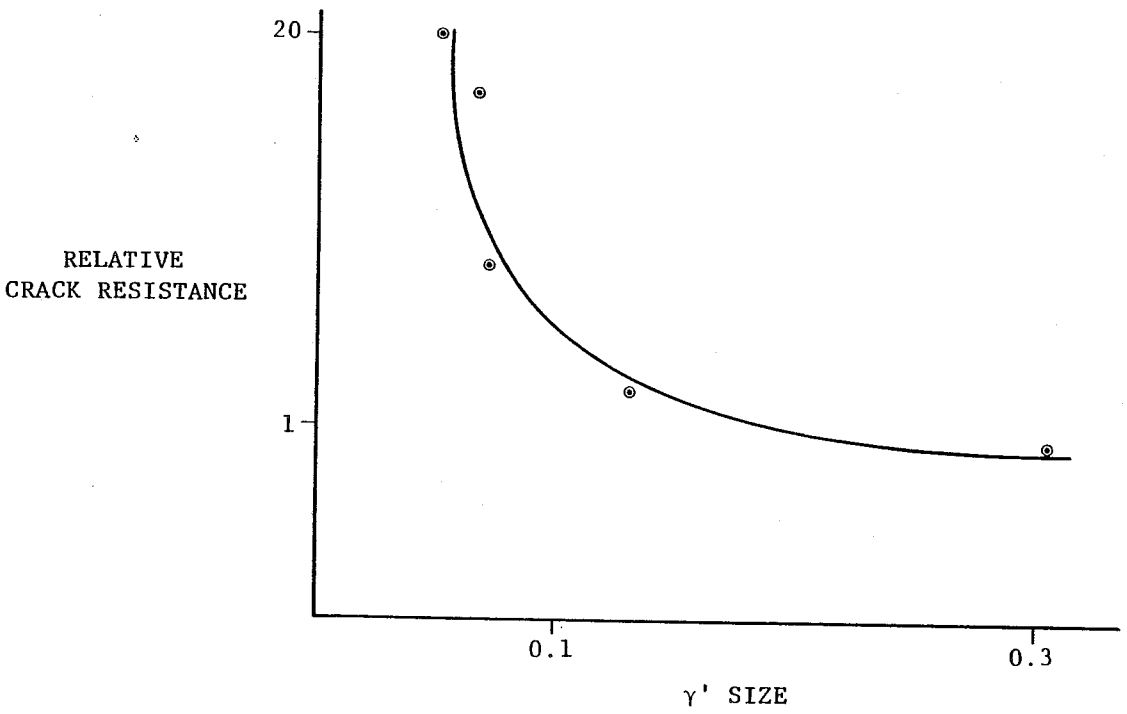
FIG. 3 shows the fatigue life resulting from different gamma prime particle sizes.

The invention process has been previously described and is illustrated schematically in FIGS. 1 and 2. The information in Tables I–IV in combination with that description will enable one skilled in the art to practice the invention process on a variety of commonly used superalloy disk materials. What follows are several illustrative examples.

EXAMPLE 1

This example describes the processing of small, 20 pound, MERL 76 (whose gamma prime solvus is about 2175° F.) parts for optimum fatigue resistance. The correct coarse gamma prime grain distribution, concentrated mainly at grain boundaries is established using a first heat treatment at 2140° F. for 2 hours followed by forced air cooling at a rate of approximately 100° F. per hour to 1800° F. and then cooling to room temperature.

The next step produces a very fine gamma prime dispersion within the grains, by heat treating at 2075° F. for 2 hours and then forced air cooling to room temperature. The parts are then aged at 1350° F. for 16 hours.

EXAMPLE 2

Another small MERL 76 part was processed as described in Example 1 except that the first heat treatment step (at 2140° F.) and subsequent controlled cooling was omitted.

EXAMPLE 3

This example illustrates a prior art treatment applied to small MERL 76 components.

Solution: 2090° F./2 hours/oil quench

Stabilize: 1800° F./1 hour/forced aircool

Age: 1350° F./8 hours/air cool

Figure 4:
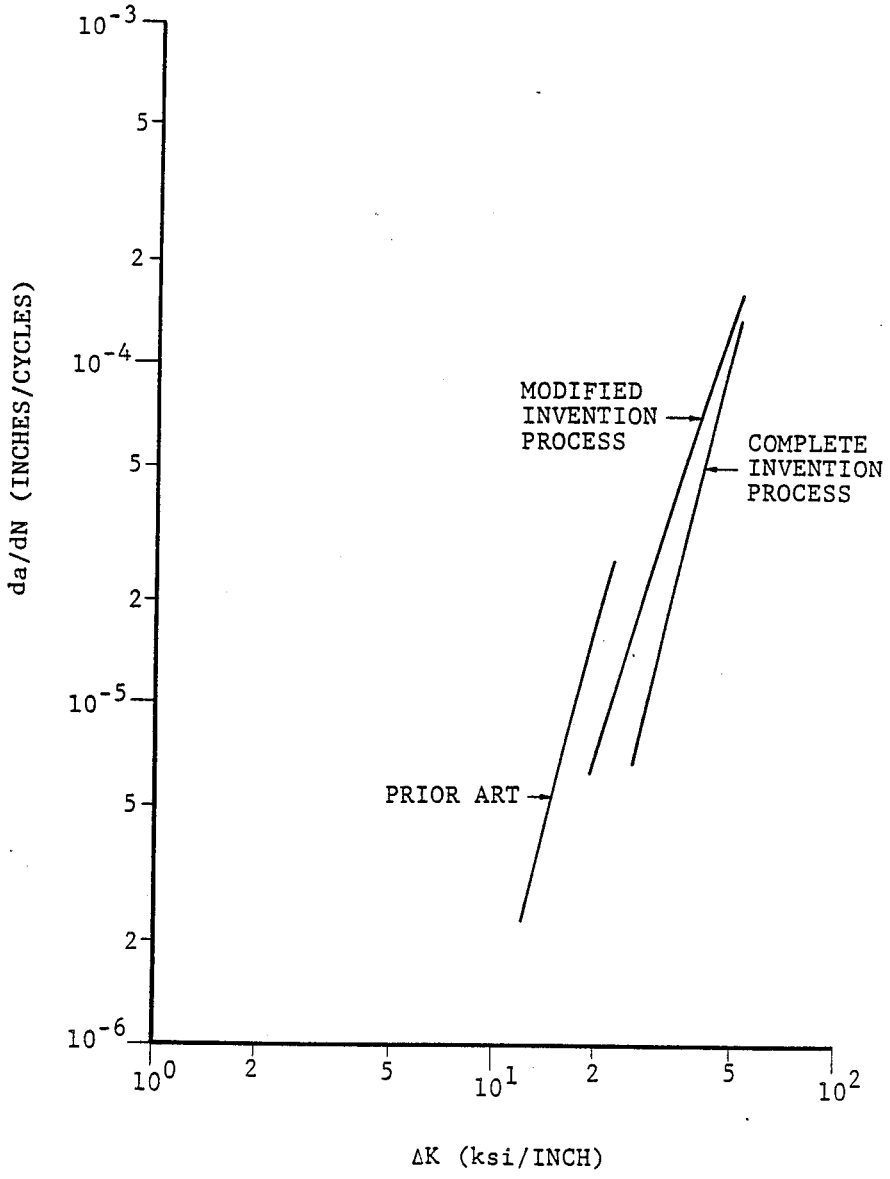
FIG. 4 shows the effect of two versions of the invention process on the fatigue behavior of MERL 76.

FIG. 4 illustrates the crack growth (da/dN) behavior of the material processed according to example 1, the invention process, Example 2, the shortened or modified invention process and Example 3, the prior art process. It can be seen that the invention process provides a substantial improvement in crack growth behavior and that the shortened invention step produces a reduced benefit.

EXAMPLE 4

This example deals again with the MERL 76 material but teaches how to heat treat this material in large size components, namely components having a thickness of greater than about 2 inches and/or weighing more than about 100 pounds. Typical of such articles would be gas turbine disk forgings. Such thick starting sections are subsolution treated at 2140° F. for 2 hours and then furnace cooled at about 100° F. per hour to 1900° F. and then forced air cooled to room temperature. The forgings are then heat treated at 1975° F. for 2 hours and oil quenched. The final step is a 1350° F. stabilization treatment for sixteen hours.

EXAMPLE 5

Figure 5:
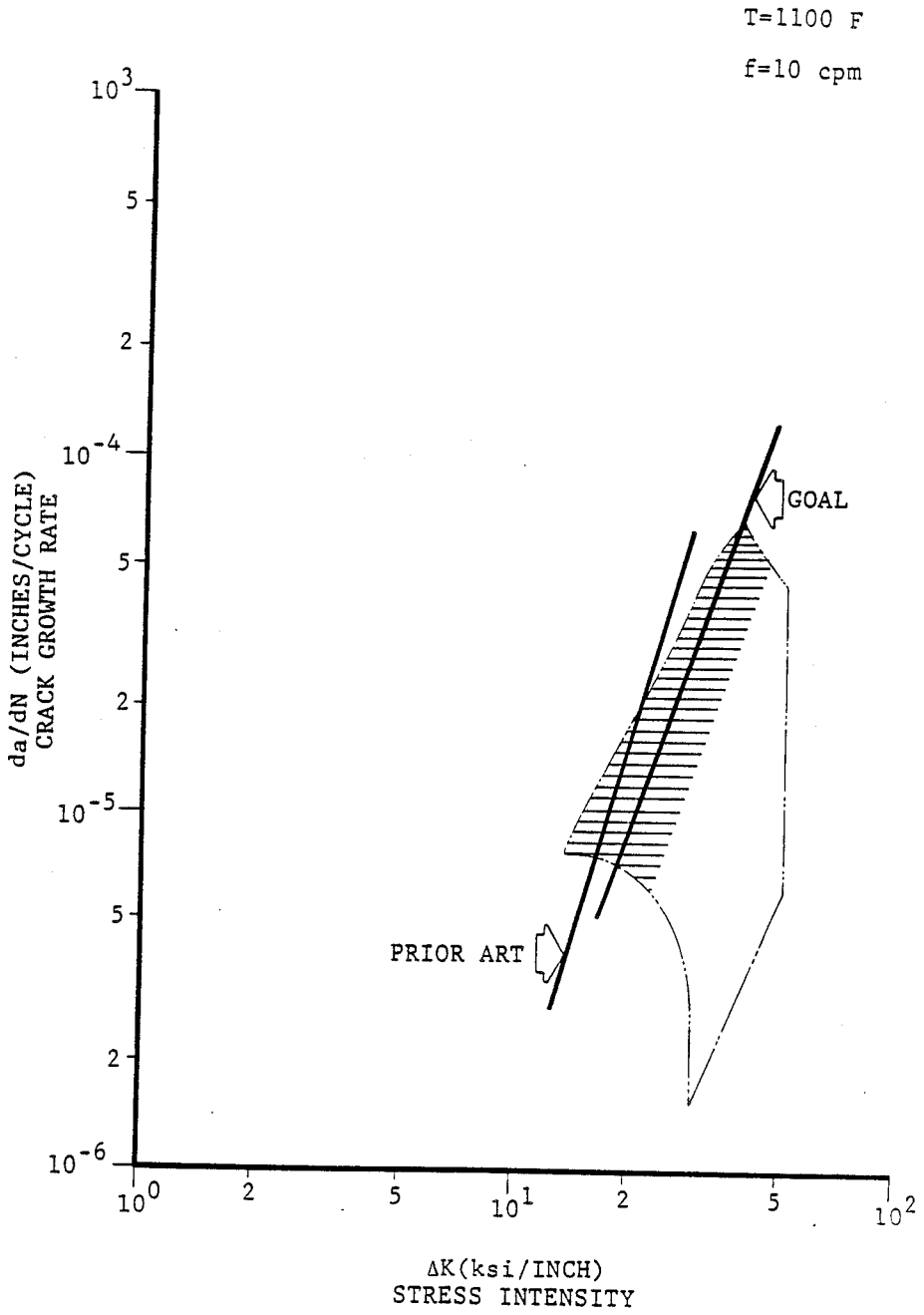
FIG. 5 shows the fatigue life benefit for large parts resulting from the invention process (with and without the stressing step).

This example illustrates an optional but highly advantageous invention step applicable to large size parts which have been liquid quenched. Such parts contains substantial residual stresses as a result of cooling in a liquid media. Such varying residual stresses produce highly variable fatigue results. In Example 5 a large part of the same geometry and same material as that in Example 4 was given all the heat treatment steps described in Example 4 but was then proof stressed by spinning the material at room temperature at a speed which developed stresses sufficient to overcome the quench caused stresses. The quenched part contained complex internal stresses, compressive at the surface balanced by internal tensile stresses. Such stresses vary in magnitude and sense within the part. The object of the post quench stress step is to impose external stresses sufficient to cause some local internal yielding, thereby reducing some of the quench developed residual stresses. Substantial scatter in fatigue properties was noted for samples taken from the non-spun disk compared with samples taken from the stressed disk. This is shown in FIG. 5 where the cross hatched area comprises the reduction in scatter. The line denoted "Goal" is the crack growth typical of Waspaloy, a crack growth resistant prior art material which is substantially inferior in strength to the alloys described in Table I and a clear reduction in the scatter band can be seen. This undesirable scatter was markedly reduced in the disk which was stressed by spinning. This scatter reduction is very desirable and the stress step is a preferred invention step.

Table V shows other typical mechanical properties of invention (the process including the first heat treat step) processed material and prior art processed material (both IN100 material). It can be seen that the invention process slightly reduces the yield strength but does not affect other properties.

Although this invention has been shown and described with respect to detailed embodiments thereof, it will be understood by those skilled in the art that various changes in form and detail thereof may be made without departing from the spirit and scope of the claimed invention.

TABLE I

| | Nominal Composition, Wt % | | | | |
|---|---|---|---|---|---|
| | MERL 76 | IN100 | Astro-loy | Rene 95 | Broad Range Disk Alloys |
| Cr | 12.4 | 12.35 | 15.0 | 14.0 | 10–20 |
| Co | 18.5 | 18.50 | 17.0 | 8.0 | 5–20 |
| Mo | 3.2 | 3.20 | 5.0 | 3.5 | 0–6 |
| W | — | — | — | 3.5 | 0–6 |
| Ta | — | — | — | 3.5 | 0–5 |
| Cb | 1.4 | — | — | — | 0–4 |
| Al | 5.0 | 4.95 | 4.0 | 3.5 | 2–6 |
| Ti | 4.3 | 4.35 | 3.5 | 2.5 | 1–5 |
| V | — | 0.78 | — | — | 0–1 |
| C | 0.025 | 0.07 | 0.06 | 0.15 | 0.01–0.2 |
| B | 0.02 | 0.02 | 0.03 | 0.010 | 0.01–0.05 |
| Zr | 0.06 | 0.06 | — | 0.05 | 0.02–0.08 |
| Hf | 0.40 | — | — | — | 0–1.0 |
| Ni | Balance | Balance | Balance | Balance | Balance |
| GPST | 2175° F. | 2140° F. | 2075° F. | 2100° F. | (Varies) |

(GPST = Gamma Prime Solvus Temp.)

TABLE II

| Typical Small Part Invention Process Parameters | | | | |
|---|---|---|---|---|
| | MERL 76 | IN100 | ASTRO-LOY | RENE 95 |
| Gamma Prime Solvus Temp. | 2175° F. | 2140° F. | 2075° F. | 2100° F. |
| I | | | | |
| a. temp. | 2140° F. | 2105° F. | 2040° F. | 2065° F. |
| b. time | 2 hrs. | 2 hrs. | 2 hrs. | 2 hrs. |
| c. cooling rate | 100° F./hr. | 100° F./hr. | 100° F./hr. | 100° F./hr. |
| d. controlled cool end | 1900° F. | 1850° F. | 1800° F. | 1800° F. |
| II | | | | |
| a. temp. | 1975° F. | 1940° F. | 1875° F. | 1900° F. |
| b. time | 2 hrs. | 2 hrs. | 2 hrs. | 2 hrs. |
| c. cooling technique | forced air | forced air | forced air | forced air |
| III | | | | |
| a. temp. | 1350° F. | 1350° F. | 1350° F. | 1350° F. |
| b. time | 16 hrs. | 16 hrs. | 16 hrs. | 16 hrs. |

TABLE III

| Typical Medium Part Invention Process Parameters | MERL 76 | IN100 | ASTRO-LOY | RENE 95 |
|---|---|---|---|---|
| Gamma Prime Solvus Temp. | 2175° F. | 2140° F. | 2075° F. | 2100° F. |
| I | | | | |
| a. temp. | 2140° F. | 2105° F. | 2040° F. | 2065° F. |
| b. time | 2 hrs. | 2 hrs. | 2 hrs. | 2 hrs. |
| c. cooling rate | 100° F./hr. | 100° F./hr. | 100° F./hr. | 100° F./hr. |
| d. controlled cool end | 1900° F. | 1850° F. | 1800° F. | 1800° F. |
| II | | | | |
| a. temp. | 1975° F. | 1940° F. | 1895° F. | 1900° F. |
| b. time | 2 hrs. | 2 hrs. | 2 hrs. | 2 hrs. |
| c. cooling technique | forced air | forced air | forced air | forced air |
| III | | | | |
| a. temp. | 1350° F. | 1350° F. | 1350° F. | 1350° F. |
| b. time | 16 hrs. | 16 hrs. | 16 hrs. | 16 hrs. |

TABLE IV

| Typical Large Part Invention Process Parameters | MERL 76 | IN100 | ASTRO-LOY | RENE 95 |
|---|---|---|---|---|
| Gamma Prime Solvus Temp. | 2175° F. | 2140° F. | 2075° F. | 2100° F. |
| I | | | | |
| a. temp. | 2140° F. | 2105° F. | 2040° F. | 2065° F. |
| b. time | 2 hrs. | 2 hrs. | 2 hrs. | 2 hrs. |
| c. cooling rate | 100° F./hr. | 100° F./hr. | 100° F./hr. | 100° F./hr. |
| d. controlled cool end | 1900° F. | 1850° F. | 1800° F. | 1800° F. |
| II | | | | |
| a. temp. | 1975° F. | 1940° F. | 1875° F. | 1900° F. |
| b. time | 2 hrs. | 2 hrs. | 2 hrs. | 2 hrs. |
| c. cooling technique | oil quench | oil quench | oil quench | oil quench |
| III | | | | |
| a. temp. | 1350° F. | 1350° F. | 1350° F. | 1350° F. |
| b. time | 16 hrs. | 16 hrs. | 16 hrs. | 16 hrs. |

TABLE V

| Test Temp. | 0.2% Y.S. (KSI) | U.T.S. (KSI) | El. (%) | R.A. (%) |
|---|---|---|---|---|
| | Conventional Process | | | |
| RT | 160 | 230 | 25 | 30 |
| 1150° F. | 155 | 200 | 20 | 20 |
| | Invention Process | | | |
| RT | 150 | 230 | 25 | 25 |
| 1150° F. | 150 | 200 | 25 | 25 |

We claim:

1. Method of heat treating a nickel base superalloy article containing 40–70 volume % of the gamma-prime phase, having a gamma prime solvus temperature and a starting grain size, including the steps of:

a. producing a concentration of coarse gamma prime particles concentrated at the grain boundaries by holding the article at a first heat treat temperature about 10°–50° F. below the gamma prime solvus for at least 0.5 hour and cooling the article at about 20°–200° F./per hour to a temperature at least about 200° F. below the first heat treat temperature;

b. producing a fine dispersion of the gamma prime phase within the grains by heating to a second heat treat temperature about 10°–250° F. below the first heat treat temperature for at least 0.5 hour and then rapidly cooling to below about 1200° F.; and c. stabilizing the gamma prime particles within the grains by heating the article to 1200°–1500° F. for about 1–25 hours;

whereby a fatigue resistant structure containing coarse grain boundary gamma prime and fine gamma prime particles within the grains, and having a grain size essentially that of the starting grain size results.

2. Method as in claim 1, particularly adapted for use with small parts up to about one inch thick and/or up to about 20 pounds in weight, wherein the second heat treat temperature is 10°–100° F. below the first heat treat temperature and the parts are cooled from the second heat treat temperature at a rate at least equal to that produced by forced air cooling.

3. Method as in claim 1, particularly adapted for use with moderate size parts, from about 20–100 pounds in weight and/or from 1–2 inches thick, wherein the second heat treat temperature is about 75°–150° F. below the first heat treat temperature, and the parts are cooled from the second heat treat temperature at a rate at least equal to that produced by forced air cooling.

4. Method as in claim 1 particularly adapted to parts more than about 2 inches thick and/or weighing more than about 100 pounds, in which the second heat treat temperature is about 100°–250° F. below the first heat treat temperature and the part is then liquid quenched.

5. Method as in claim 4 wherein the part is stressed prior to step "c".

6. A fatigue resistant superalloy article having a fine grain size, ASTM 8 to 12, a distribution of coarse (1–5 microns) gamma prime particles at the grain boundaries and a distribution of 0.02–0.15 micron gamma prime particles within the grains.

7. Method for heat treating gamma prime strengthened nickel base superalloys, having a characteristic gamma prime solvus temperature and an initial grain size and comprising grains separated by grain boundaries, for improved fatigue properties, including the steps of:

a. heating the alloy to a temperature near but below the gamma prime solvus and cooling at a controlled rate to develop a distribution of coarse (1–5 microns) gamma prime particles at the grain boundaries;

b. heating the alloy to a temperature near but below the gamma prime solvus and rapidly cooling, with the temperature and cooling rate being coordinated to produce a distribution of fine (0.02–0.15 micron) gamma prime particles within the grains; and c. heating the alloy to a moderate temperature to stabilize the microstructure;

whereby the alloy maintains essentially its original grain size and has a microstructure comprised of coarse gamma prime particles located primarily at the grain boundaries and fine gamma prime particles within the grains and is resistant to fatigue crack initiation and growth.

8. Method for heat treating gamma prime strengthened nickel base superalloys, having a characteristic gamma prime solvus temperature and an initial grain size and comprising grains separated by grain boundaries, for improved fatigue properties, including the steps of:

a. heating the alloy to a temperature near but below the gamma prime solvus and rapidly cooling, with the temperature and cooling rate being coordinated to produce a distribution of fine (0.02–0.15 micron) gamma prime particles within the grains; and b. heating the alloy to a moderate temperature to stabilize the microstructure;

whereby the alloy maintains essentially its original grain size and has a microstructure comprised of original gamma prime particles and fine gamma prime particles within the grains and is resistant to fatigue crack initiation and growth.

* * * * *